United States Patent [19]

Guimier et al.

[11] Patent Number: 4,900,220

[45] Date of Patent: Feb. 13, 1990

[54] TURBO-ENGINE EXHAUST GAS HOUSING WITH TEMPERATURE CONTROL DEVICE

[75] Inventors: Michel S. Guimier, Mormani; Patrick Kapala, Claye Souilly; Philippe Paris, Le Mee sur Seine, all of France

[73] Assignee: Societe Nationale d'Etude et de Construction de Moteurs d'Aviation "S.N.E.C.M.A.", Paris, France

[21] Appl. No.: 335,954

[22] Filed: Apr. 10, 1989

[30] Foreign Application Priority Data

Apr. 13, 1988 [FR] France ..... 88 04860

[51] Int. Cl.[4] ..... F01D 19/02

[52] U.S. Cl. ..... 415/136; 415/47; 415/144

[58] Field of Search ..... 415/134, 135, 136, 137, 415/138, 139, 115, 116, 175, 176, 177, 47, 144; 60/39.75, 39.83

[56] References Cited

U.S. PATENT DOCUMENTS

| | | | |
|---|---|---|---|
| 3,031,132 | 4/1962 | Davies | 415/47 |
| 3,452,542 | 7/1969 | Saferstein et al. | 60/39.75 |
| 3,704,075 | 11/1972 | Karstensen et al. | 415/68 |
| 4,156,342 | 5/1979 | Korta et al. | 60/39.83 |
| 4,321,007 | 3/1982 | Dennison et al. | 415/142 |
| 4,338,061 | 7/1982 | Beitler et al. | 415/47 |
| 4,416,111 | 11/1983 | Lenahan et al. | 415/115 |
| 4,715,779 | 12/1987 | Suciu | 415/144 |

FOREIGN PATENT DOCUMENTS

| | | |
|---|---|---|
| 1360000 | 3/1964 | France . |
| 512664 | 10/1971 | Switzerland . |

*Primary Examiner*—Robert E. Garrett
*Assistant Examiner*—John T. Kwon
*Attorney, Agent, or Firm*—Oblon, Spivak, McClelland, Maier & Neustadt

[57] ABSTRACT

A unitary exhaust gas housing for a turbo-engine comprises an outer ring, two intermediate rings defining the flow path for the hot gases, and an inner ring forming a hub with a hollow annular chamber. A temperature control device is provided including a bleed tube having one end fixed and communicating with the gas flow path for drawing off hot gases therefrom, the other end of the tube passing into the hollow chamber of the hub where it regulates the flow of gases by variation of the clearance j between the end of the tube and the opposing wall of the hub in response to relative radial movements of the tube and the hub according to the thermal states of the assembly.

3 Claims, 2 Drawing Sheets

TURBO-ENGINE EXHAUST GAS HOUSING WITH TEMPERATURE CONTROL DEVICE

BACKGROUND OF THE INVENTION

1. Field of the Invention

The present invention concerns a unitary exhaust gas housing for a turbo-engine fitted with a temperature control device.

2. Summary of the Prior Art

It is usual practice with gas turbine engines to provide downstream of the turbine a one-piece housing comprising radial struts linking outer and inner annular parts which together form a duct for the flow of the hot gases.

One of the applications particularly envisaged by the invention is the case of an aircraft propulsion unit comprising a gas generator downstream of which are associated free turbines, in which the continuity of the aerodynamic flow path for the hot gases is ensured by an assembly of the above-mentioned type which, in this instance, is called the inter-turbine structure. This unitary assembly, consisting for example of a single cast component, forms, in this instance, four coaxial rings connected by a series of shaped struts; an outer ring which forms the outer skin of the engine of this region, two intermediate rings which form the outer and inner walls of the gas path, and an inner box-section ring forming the hub and central support of the whole structure. In the course of operation of the engine, large temperature gradients appear within this interturbine structure between components in direct contact with the flow of hot gases emerging from the gas generator turbines, and the internal hub which remains relatively cool. These thermal gradients are the cause of high mechanical stresses, particularly in the form of thermal shocks during the transient operating phases of the engine, such as, in the case of aircraft use, during take-off, and are prejudicial to good component performance in service. Attempts to solve the problem, for example, by heating the hub by means of air drawn from that circulated within the struts of the structure have proved inadequate.

The invention aims to solve the problem whilst, at the same time, avoiding measures which would prejudice the efficiency of the thermodynamic cycle during stable operating phases of the engines, notably when cruising in the case of aircraft, and to this end, proposes to limit the periods during which gas is withdrawn for heating the hub to the transient phases of operation, during which heating of the inner hub of the unitary structure is useful.

SUMMARY OF THE INVENTION

According to the invention there is provided a temperature control device in a unitary exhaust gas housing for a turbo-engine comprising an outer ring, two intermediate rings defining the flow path for the hot gases, shaped struts interconnecting said intermediate rings, and an inner ring forming a hub of said housing, said hub defining a closed annular chamber, said temperature control device comprising a bleed tube for drawing off gas from the gas stream in said gas flow path, said tube extending into said closed annular chamber formed by said hub, said tube having a fixed first end in communication with said gas flow path and a second end disposed in said annular chamber, and a wall of said hub spaced from said second end of said tube by a clearance j whereby the flow of gas entering said annular chamber from said gas stream is regulated by variations in said clearance j resulting from radial movements of the tube and the hub relative to one another caused by their thermal state.

In a preferred embodiment of the invention said inner intermediate ring is provided with a bleed hole and said first end of said bleed tube is fixed to said inner intermediate ring to cooperate with said bleed hole, said hub has a radially outer portion provided with a guide hole through which said bleed tube is slidable, said second end of said bleed tube comprises an annular flange, and a block is mounted in the radially inner part of said hub facing said annular flange.

In this case, means is preferably associated with said block whereby the radial position of said block can be adjusted in order to set the cold clearance $j_o$ between said annular flange and the face of said block.

Other features and advantages of the invention will become apparent from the following description of an embodiment of the invention with reference to the drawings.

DESCRIPTION OF THE PREFERRED EMBODIMENT

Figure 1:
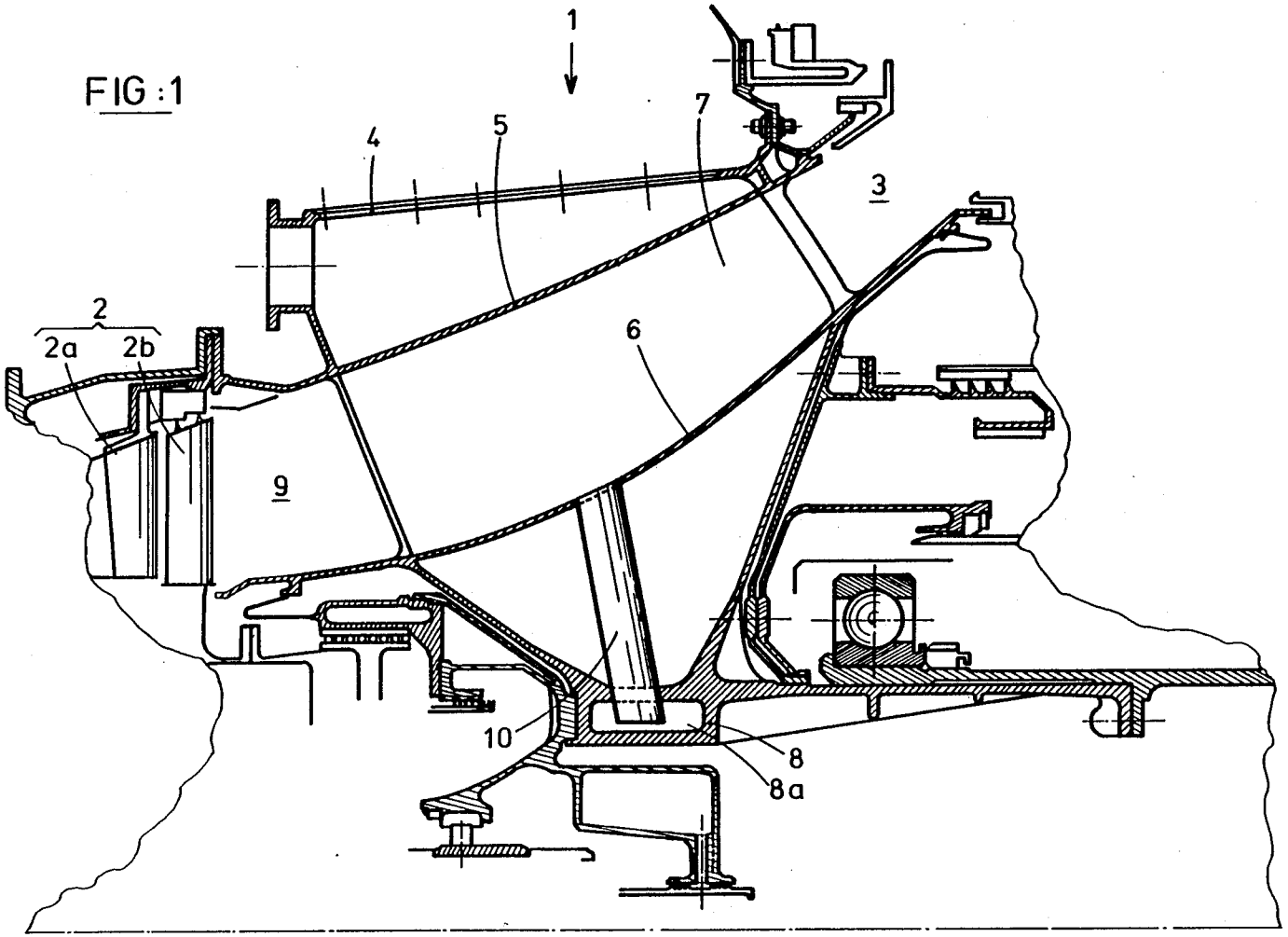
FIG. 1 shows in diagrammatic form, a longitudinal section of part of a turbo-engine, taken in a plane through the axis of rotation of the engine, showing the exhaust gas housing, or inter-turbine structure, fitted with an example of the temperature control device in accordance with the invention.

FIG. 1 shows a part of a propulsion unit of known type comprising a gas generator associated with free turbines. A unitary inter-turbine structure 1 is disposed between a low-pressure turbine 2 of the gas generator, of which only the two downstream stages of blades **2*a* and 2*b* are shown in the drawing, and the said free turbines, of which only the inlet duct 3 has been shown. The said inter-turbine structure, or exhaust gas housing, 1 comprises an outer ring 4, forming the outer skin of the engine at this point, an outer intermediate ring 5 and an inner intermediate ring 6 connected to each other by a number of shaped struts 7 arranged at regular intervals around the circumference of the rings, and an innermost box-sectioned ring defining a hub 8 having an annular box chamber 8*a*. The intermediate rings 5 and 6 define a duct 9** for the flow of hot gases between the outlet from the turbine of the gas generator and the inlet to the free turbines.

Figure 2:
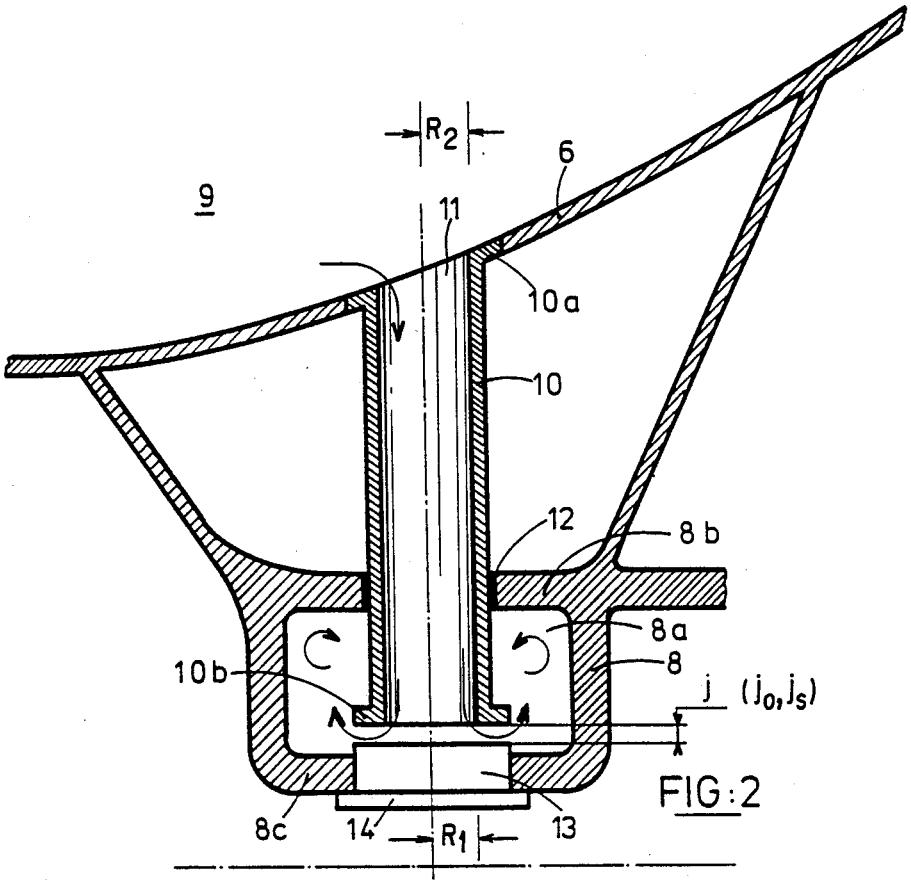
FIG. 2 shows in diagrammatic form, and to a larger scale, a detail of FIG. 1 showing the temperature control device.
Figure 3:
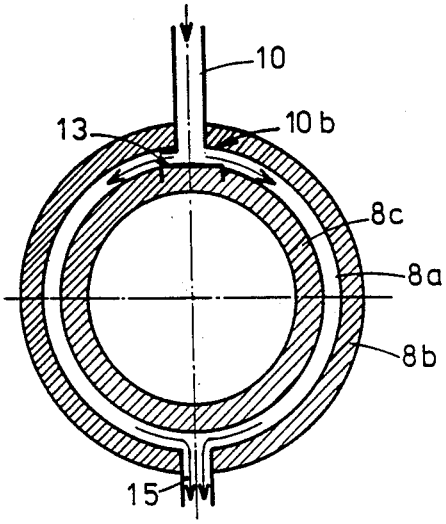
FIG. 3 shows in diagrammatic form a cross section of the hub of the exhaust gas housing incorporating the temperature control device.

As shown in greater detail in FIGS. 2 and 3, the interturbine structure 1 is associated, in accordance with the invention, with a temperature control device for ensuring heating of the hub 8 during transient operational phases of the engine, particularly during take-off.

This device comprises a tube 10 of which a first end **10*a* is fixed to the internal intermediate ring 6 in registry with a bleed hole 11 which connects the tube to the stream of hot gases flowing in the duct 9. The tube 10 passes through a hole 12 formed in the radially outer annular portion 8b of the hub 8, this hole acting as a guide in which the tube may slide. The radially inner portion of the tube 10 is therefore sited in the annular chamber 8a of the hub 8 and terminates in an annular flange 10b at the second end of the tube. On the radially inner annular portion 8c of the hub 8, opposite the second end 10b of the tube 10, there is mounted a block 13 which may be adjusted radially in position by means 14 of any known type, for example by means of a screw. A cold clearance $j_o$ can thus be set between the opposing faces of the flange 10b and the block 13**.

On the side of the hub diametrically opposite the position of the hole 12 which allows the tube 10 to pass through the outer wall 8b of the hub 8 into the annular chamber 8a there is a hole 15 for the exit of the gases which have circulated within the annular chamber 8a.

The operation of the temperature control device associated with the inter-turbine structure 1 which has just been described may be briefly explained in the following way. If the radius of the second end 10b of the tube 10 is defined as $R_1$, the radius of the first end 10a of the tube 10 is defined as $R_2$, the temperature of the hub 8 at any given moment during the operation of the engine is defined as $T_1$, the temperature of the inner intermediate ring 6 and the tube 10, which for practical purposes are always identical, is defined as $T_2$, and the coefficient of thermal expansion, also assumed to be the same for the said intermediate ring 6 and the tube 10, is defined as a, the variation in clearance j between the face of the flange 10b at the end of tube 10 and the opposing face of the block 13 is given by:

$$\Delta j = aR_2T_2 - a(R_2 - R_1)\,T_2 - aR_1T_1$$

thus, one obtains $$\Delta j = aR_1(T_2 - T_1) \qquad (1)$$

At rest, with the engine cold, a clearance $j_o$ is set which is slightly less than the clearance $j_s$ which develops under stable running conditions.

On engine start-up, $T_2$ increases very rapidly in relation to $T_1$. It follows from the equation (1) that the clearance j assumes a maximum value corresponding also to the maximum flow of hot gases drawn off for heating the hub 8. On account of the efficiency of the heating of the hub which the temperature control device has been designed to achieve, the temperature $T_1$ approaches $T_2$ very rapidly, and the difference between $T_2$ and $T_1$ reduces to a minimal value as does the variation in the clearance which stabilises at the value $j_s$.

Upon deceleration of the engine, the bleed which takes place delays the appearance of an inverted temperature gradient such that the temperature $T_1$ becomes superior to $T_2$, which corresponds to a clearance of less than the initial value $j_o$.

The invention which has been described thus allows the desired result to be obtained by means of adjustment of the flow of gases drawn off caused by variation of the clearance j, corresponding to the cross sectional area available for the passage of the heating gases, resulting from the differential rates of thermal expansion of the rings of the inter-turbine structure 1 and the bleed tube 10. The maximum rate of flow of hot gases is obtained in transient phases of operation of the engine when the hub needs to be heated, and conversely, the minimum rate is assured under stable running conditions, thus avoiding any adverse effect on the performance of the engine.

We claim:

1. A temperature control device in a unitary exhaust gas housing for a turbo-engine comprising an outer ring, two intermediate rings defining the flow path for the hot gases, shaped struts interconnecting said intermediate rings, and an inner ring forming a hub of said housing, said hub defining a closed annular chamber, said temperature control device comprising a bleed tube for drawing off gas from the gas stream in said gas flow path, said tube extending into said closed annular chamber formed by said hub, said tube having a fixed first end in communication with said gas flow path and a second end disposed in said annular chamber, and a wall of said hub spaced from said second end of said tube by a clearance j whereby the flow of gas entering said annular chamber from said gas stream is regulated by variations in said clearance j resulting from radial movements of the tube and the hub relative to one another caused by their thermal state.

2. A unitary exhaust gas housing in accordance with claim 1, wherein said inner intermediate ring is provided with a bleed hole and said first end of said bleed tube is fixed to said inner intermediate ring to cooperate with said bleed hole, said hub has a radially outer portion provided with a guide hole through which said bleed tube is slidable, said second end of said bleed tube comprises an annular flange, and a block is mounted in the radially inner part of said hub facing said annular flange.

3. A unitary exhaust gas housing in accordance with claim 2, wherein means is associated with said block whereby the radial position of said block can be adjusted in order to set the cold clearance $j_o$ between said annular flange and the face of said block.

* * * * *

UNITED STATES PATENT AND TRADEMARK OFFICE

CERTIFICATE OF CORRECTION

PATENT NO. : 4,900,220

DATED : FEBRUARY 13, 1990

INVENTOR(S) : MICHEL S. GUIMIER,et al

It is certified that error appears in the above-identified patent and that said Letters Patent is hereby corrected as shown below:

In column 1, line 31, change "interturbine" to --inter-turbine--;

In column 1, line 47, change "engines" to --engine--;

In column 2, line 48, change "housing," to --housing 1,--;

In column 2, line 49, delete "1";

In column 2, line 60, change "interturbine" to --inter-turbine--;

In column 3, line 50, change "stabilises" to --stabilizes--.

Signed and Sealed this

Twenty-third Day of July, 1991

*Attest:*

*Attesting Officer*

HARRY F. MANBECK, JR.

*Commissioner of Patents and Trademarks*